US011391066B2

(12) United States Patent
Liu et al.

(10) Patent No.: US 11,391,066 B2
(45) Date of Patent: Jul. 19, 2022

(54) ELECTRONIC CABINET LOCK

(71) Applicant: XIAMEN HEADLEADER TECHNOLOGY CO., LTD., Fujian (CN)

(72) Inventors: Tingpeng Liu, Xiamen (CN); Junmin Lin, Xiamen (CN); Jiasheng Zhang, Xiamen (CN); Binghuang Chen, Xiamen (CN)

(73) Assignee: XIAMEN HEADLEADER TECHNOLOGY CO., LTD., Fujian (CN)

( * ) Notice: Subject to any disclaimer, the term of this patent is extended or adjusted under 35 U.S.C. 154(b) by 586 days.

(21) Appl. No.: 16/378,570

(22) Filed: Apr. 9, 2019

(65) Prior Publication Data

US 2020/0190857 A1 Jun. 18, 2020

(30) Foreign Application Priority Data

Dec. 18, 2018 (CN) ..... 201811549372.4

(51) Int. Cl.

| | |
|---|---|
| ***E05B 47/00*** | (2006.01) |
| ***E05B 9/02*** | (2006.01) |
| ***E05B 15/04*** | (2006.01) |
| ***E05B 17/22*** | (2006.01) |
| ***E05B 17/00*** | (2006.01) |

(52) U.S. Cl.

CPC ..... *E05B 47/0012* (2013.01); *E05B 9/02* (2013.01); *E05B 15/04* (2013.01); *E05B 17/22* (2013.01); *E05B 17/0029* (2013.01); *E05B 2015/0448* (2013.01); *E05B 2047/0016* (2013.01); *E05B 2047/0017* (2013.01); *E05Y 2900/20* (2013.01)

(58) Field of Classification Search

CPC ..... E05B 47/0012; E05B 17/0029

See application file for complete search history.

(56) References Cited

U.S. PATENT DOCUMENTS

| | | | | |
|---|---|---|---|---|
| 4,441,020 | A * | 4/1984 | Sakamoto | B23Q 35/128 250/202 |
| 5,896,765 | A * | 4/1999 | Peyre | B60R 25/02153 70/186 |
| 6,651,466 | B1 * | 11/2003 | Shih | E05B 63/044 292/165 |
| 2002/0167177 | A1 * | 11/2002 | Erices | E05B 85/02 292/201 |
| 2003/0227177 | A1 * | 12/2003 | Matsuda | E05B 81/06 292/216 |

(Continued)

*Primary Examiner* — Kristina R Fulton
*Assistant Examiner* — Matthew Thomas Evanko
(74) *Attorney, Agent, or Firm* — Leong C. Lei

(57) ABSTRACT

An electronic cabinet lock includes a lock housing, a lock body, a limiting member, a motor, and a main control board. The lock body and the limiting member are rotatably disposed in the lock housing, respectively. The motor is electrically connected to the main control board. The limiting member is driven by the motor through a transmission mechanism. The transmission mechanism includes a screw rod driven by the motor and a slider threadedly connected to the screw rod. The slider is slidably disposed in the lock housing, and is movably connected to the limiting member. The transmission mechanism has few components, which is a simple structure and convenient for assembly.

13 Claims, 8 Drawing Sheets

(56) References Cited

U.S. PATENT DOCUMENTS

| | | | | |
|---|---|---|---|---|
| 2007/0257773 | A1* | 11/2007 | Hill | E05B 47/0012 340/5.73 |
| 2010/0193637 | A1* | 8/2010 | Szarszewski | B64C 1/18 244/129.1 |
| 2014/0021843 | A1* | 1/2014 | Hashemi | E05B 47/0001 312/333 |
| 2016/0130840 | A1* | 5/2016 | Garneau | E05B 47/0012 292/201 |
| 2016/0208520 | A1* | 7/2016 | Jordan | E05B 47/0607 |

* cited by examiner

ELECTRONIC CABINET LOCK

BACKGROUND OF THE INVENTION

1. Field of the Invention

The present invention relates to an electronic lock, and more particularly to an electronic cabinet lock.

2. Description of the Prior Art

An electronic cabinet lock generally includes a lock housing, a lock body, a limiting member and so on. The lock body and the limiting member are rotatably disposed in the lock housing. The lock body has an engaging groove configured to mate with a lock hook on a door. A detent structure is provided between the lock body and the limiting member for the limiting member to limit the lock body. A conventional electronic cabinet lock uses an electromagnetic mechanism to control the swing of the limiting member for releasing the lock body to open the door. However, the electronic cabinet lock using the electromagnetic mechanism consumes much power because the electromagnetic mechanism needs to be driven by large current. When the electronic cabinet lock using the electromagnetic mechanism is applied to a cabinet with multiple cabinet bodies, it is necessary to mount the electronic cabinet lock using the electromagnetic mechanism on each cabinet body. In order to reduce energy consumption, only a single cabinet body is used for opening the door, which is inconvenient for use. Thus, an improved electronic cabinet lock uses a motor in cooperation with a mechanical transmission mechanism to control the swing of the limiting member. This electronic cabinet lock driven by the motor has the characteristics of small current, low cost, and low damage. However, this electronic cabinet lock also has the following disadvantages. The motor is controlled by a mechanical transmission mechanism composed of a gear reduction group, a push rod and the like to control the swing of the limiting member. The mechanical transmission mechanism has many components and complicated structures. As a result, it is troublesome to assemble the mechanical transmission mechanism. Moreover, the mechanical failure rate of the mechanical transmission mechanism is high in use, which affects the use of the electronic cabinet lock greatly.

Accordingly, the inventor of the present invention has devoted himself based on his many years of practical experiences to solve these problems.

SUMMARY OF THE INVENTION

The primary object of the present invention is to provide an electronic cabinet lock, and its transmission mechanism has a simple structure and is convenient for assembly.

In order to achieve the above object, the present invention adopts the following technical solutions:

An electronic cabinet lock comprises a lock housing, a lock body, a limiting member, a motor, and a main control board. The lock body and the limiting member are rotatably disposed in the lock housing, respectively. A first elastic member for returning the lock body is disposed between the lock body and the lock housing. The lock body is provided with an engaging groove configured to mate with a lock hook on a door. A detent structure is provided between the lock body and the limiting member for the liming member to limit the lock body. The motor is electrically connected to the main control board. The limiting member is driven by the motor through a transmission mechanism. The transmission mechanism includes a slider and a screw rod. The slider is slidably disposed in the lock housing through a sliding guide structure, and is movably connected to the limiting member. The screw rod is driven to rotate by the motor. The screw rod is threadedly connected to the slider for driving the slider to slide.

Preferably, the limiting member has a predetermined movable space relative to the slider. The limiting member is driven by the motor and the transmission mechanism to rotate so as to release the lock body. A second elastic member for returning the limiting member is disposed between the limiting member and the lock housing.

Preferably, the slider is provided with an elongate hole in a longitudinal direction along a sliding direction of the slider. The limiting member is provided with a rod. The rod is slidably connected to the elongate hole.

Preferably, the lock housing is provided with an emergency unlocking hole for manually rotating the limiting member to release the lock body.

Preferably, the emergency unlocking hole is a first through hole that is formed on the lock housing and corresponds in position to an end of the limiting member.

Preferably, a free end of the rod extends out of the elongate hole. The emergency unlocking hole is a second through hole that is formed on the lock housing and corresponds in position to the free end of the rod.

Preferably, one end of the slider is threadedly connected to the screw rod. Another end of the slider is provided with a perforation communicating with the elongate hole and extending along the sliding direction of the slider. The emergency unlocking hole is a third through hole that is formed on the lock housing and corresponds to the perforation.

Preferably, the lock body is provided with a ball. The lock housing is provided with a limiting portion to cooperate with the ball. When the lock body is rotated to a locked position, the ball abuts against the limiting portion and restricts the first elastic member from driving the lock body to be returned.

Preferably, the electronic cabinet lock further comprises a first switch mechanism controlled by the lock body and a second switch mechanism controlled by the limiting member. The first switch mechanism and the second switch mechanism are electrically connected to the main control board for controlling a working state of the motor.

Preferably, the first switch mechanism is a micro switch that is activated when the lock body is rotated to a locked position, and the micro switch is disposed in the lock housing. Alternatively, the first switch mechanism is a first Hall switch that includes a first magnet disposed on the lock body and a first magnetic field detecting part electrically connected to the main control board. When the lock body is rotated to the locked position, the first magnetic field detecting part detects a magnetic field of the first magnet.

Preferably, the second switch mechanism is a micro switch that is activated when the limiting member is rotated to a position where the lock body is released, and the micro switch is disposed in the lock housing. Alternatively, the second switch mechanism is a second Hall switch that includes a second magnet disposed on the limiting member and a second magnetic field detecting part electrically connected to the main control board. When the limiting member is rotated to the position where the lock body is released, the second magnetic field detecting part detects a magnetic field of the second magnet.

Preferably, the detent structure includes a first detent portion disposed on the lock body and a second detent portion disposed on the limiting member. The first detent portion is movably engaged with the second detent portion.

Preferably, the sliding guide structure includes a guide rail disposed on the slider and a sliding groove disposed on the lock housing. The guide rail and the sliding groove are disposed along the sliding direction of the slider and are slidably mated with each other. The screw rod is coaxially connected to an output shaft of the motor.

Preferably, the lock body is rotatably sleeved on a first rotating shaft of the lock housing. The first elastic member is a first torsion spring. A spiral portion of the first torsion spring is sleeved on the first rotating shaft. Two ends of the first torsion spring lean against the lock body and the lock housing, respectively. The limiting member is rotatably sleeved on a second rotating shaft of the lock housing. The second elastic member is a second torsion spring. A spiral portion of the second torsion spring is sleeved on the second rotating shaft. Two ends of the second torsion spring lean against the limiting member and the lock housing, respectively.

Compared with the prior art, the present invention has the following beneficial effects:

1. The transmission mechanism of the present invention includes the slider and the screw rod. The slider is slidably disposed in the lock housing through the sliding guide structure, and is movably connected to the limiting member. The screw rod is driven to rotate by the motor. The screw rod is threadedly connected to the slider for driving the slider to slide. Therefore, the transmission mechanism of the present invention has fewer components and a simpler structure. The structure is simpler, the assembly is easier, and the mechanical failure rate is lower.

2. The motor of the invention is connected with the limiting member through the transmission mechanism, and the invention further comprises an emergency unlocking structure. Specifically, the limiting member has a predetermined movable space relative to the slider. The lock housing is provided with the emergency unlocking hole for manually rotating the limiting member to release the lock body. In this way, one can release the lock body by using a tool to pass through the emergency unlocking hole for driving the limiting member to rotate, thereby performing manual unlocking.

3. The arrangement of the ball and the limiting portion of the present invention enables the present invention to restrict the first elastic member from driving the lock body to be returned after the limiting member releases the lock body. Therefore, the lock body is held in the locked position to keep the lock hook in the engaging groove of the lock body, so as to keep the door from being opened. At this time, the door needs to be pulled by hand to open the door. The invention may be applied to some cabinets (such as cabinet freezers, refrigerated cabinets, etc.) that need to reduce the time when the cabinets are in an open state. In particular, when the present invention in cooperation with a door closer is applied to such a cabinet, the effect is better. In addition, the arrangement of the ball and the limiting portion can restrict the first elastic member from driving the lock body to be returned when the door is closed, that is, when the lock hook pushes the lock body to the locked position. Thereby, the motor and the transmission mechanism have sufficient time to drive the limiting member to limit the lock body so as to complete the locking.

4. Through the arrangement of the first switch mechanism and the second switch mechanism, the invention is more intelligent and convenient to operate to facilitate the function expansion.

DETAILED DESCRIPTION OF THE PREFERRED EMBODIMENTS

Figure 1:
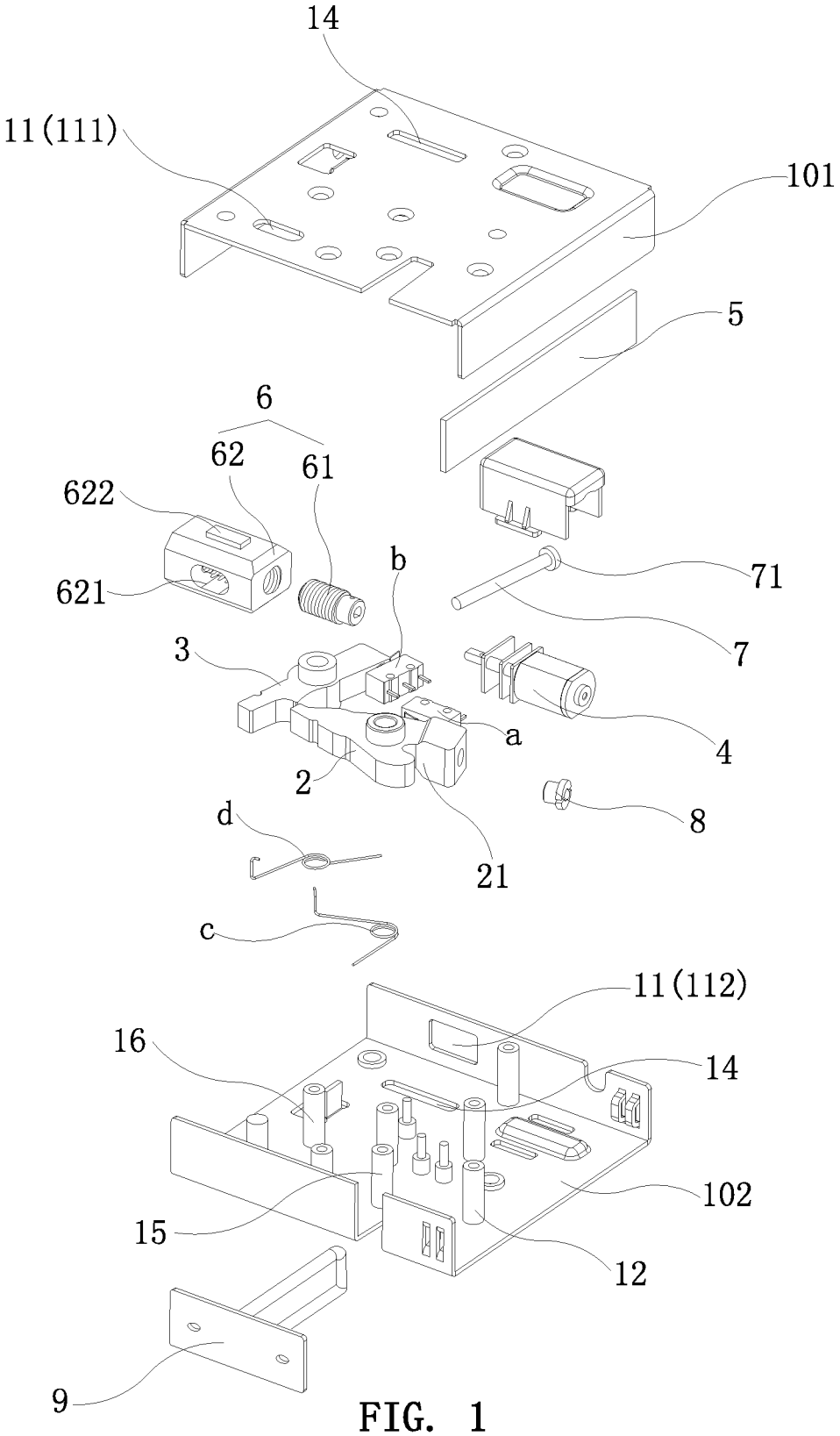
FIG. 1 is an exploded view of a first embodiment of the present invention.

Embodiments of the present invention will now be described, by way of example only, with reference to the accompanying drawings.

Referring to FIG. 1 to FIG. 12, the present invention discloses an electronic cabinet lock. The electronic cabinet lock comprises a lock housing 1, a lock body 2, a limiting member 3, a motor 4, and a main control board 5. The lock body 2 and the limiting member 3 are rotatably disposed in the lock housing 1, respectively. A first elastic member for returning the lock body 2 is disposed between the lock body 2 and the lock housing 1. The lock body 2 is provided with an engaging groove 21 configured to mate with a lock hook 9 on a door. A detent structure is provided between the lock body 2 and the limiting member 3 for the liming member 3 to limit the lock body 2. The motor 4 is electrically connected to the main control board 5. The limiting member 3 is driven by the motor 4 through a transmission mechanism 6. The transmission mechanism 6 includes a slider 62 and a screw rod 61. The slider 62 is slidably disposed in the lock housing 1 through a sliding guide structure, and is movably connected to the limiting member 3. The screw rod 61 is driven to rotate by the motor 4. Specifically, the screw rod 61 is coaxially connected to an output shaft of the motor 4. The screw rod 61 is threadedly connected to the slider 62 for driving the slider 62 to slide.

The limiting member 3 has a predetermined movable space relative to the slider 62. Specifically, the slider 62 is provided with an elongate hole 621 in a longitudinal direction along a sliding direction of the slider 62. The limiting member 3 is provided with a rod 7. The rod 7 is slidably connected to the elongate hole 621. A free end 71 of the rod 7 extends out of the elongate hole 621. Specifically, the rod 7 is a cap screw screwed to the limiting member 3, but not limited thereto. The limiting member 3 is driven by the motor 4 and the transmission mechanism 6 to rotate for releasing the lock body 2. A second elastic member for returning the limiting member 3 is disposed between the limiting member 3 and the lock housing 1.

The lock body 2 is provided with a ball 8. The lock housing 1 is provided with a limiting portion to cooperate with the ball 8. Specifically, the limiting portion is a limiting post 12. When the lock hook 9 is engaged in the engaging groove 21 of the lock body 2, the ball 8 abuts against the limiting post 12 and restricts the first elastic member from driving the lock body 2 to be returned.

The detent structure includes a first detent portion 22 disposed on the lock body 2 and a second detent portion 31 disposed on the limiting member 3. The first detent portion 22 is movably engaged with the second detent portion 31.

The lock body 2 is rotatably sleeved on a first rotating shaft 15 of the lock housing 1. The limiting member 3 is rotatably sleeved on a second rotating shaft 16 of the lock housing 1. The first detent portion 22 and the engaging groove 21 are located at opposite two ends of the lock body 2. The ball 8 and the engaging groove 21 are located at the same end of the lock body 2. The lock housing 1 is provided with a notch 13 corresponding in position to the engaging groove 21 for the lock hook on the door to pass therethrough. The second detent portion 31 is located at a side of one end of the limiting member 3. The rod 7 is connected to the other end of the limiting member 3.

The sliding guide structure includes a guide rail 622 disposed on the slider 62 and a sliding groove 14 disposed on the lock housing 1. The guide rail 622 and the sliding groove 14 are disposed along the sliding direction of the slider 62 and are slidably mated with each other. Specifically, the lock housing 1 may be composed of an upper housing 101 and a lower housing 102. The upper housing 101 and the lower housing 102 each have the sliding groove 14 at corresponding positions. The upper and lower surfaces of the slider 62 are provided with the guide rails 622 to mate with the corresponding sliding grooves 14.

The present invention further includes a first switch mechanism controlled by the lock body 2 and a second switch mechanism controlled by the limiting member 3. The first switch mechanism and the second switch mechanism are electrically connected to the main control board 5 for controlling the working state of the motor 4. As shown in FIG. 1 to FIG. 5, in a first embodiment of the present invention, the first switch mechanism is a micro switch that is activated when the lock body 2 is rotated to a locked position. The micro switch is disposed on the lock housing 1. For convenience of explanation, the micro switch is defined as a first micro switch a. The second switch mechanism is a micro switch that is activated when the limiting member 3 is rotated to a position where the lock body 2 is released. The micro switch is disposed on the lock housing 1. For convenience of explanation, the micro switch is defined as a second micro switch b.

The first elastic member is a first torsion spring c. A spiral portion of the first torsion spring c is sleeved on the first rotating shaft 15. Two ends of the first torsion spring c lean against the lock body 2 and the lock housing 1, respectively. A spiral portion of the second torsion spring d is sleeved on the second rotating shaft 16. Two ends of the second torsion spring d lean against the limiting member 2 and the lock housing 1, respectively.

Figure 2:
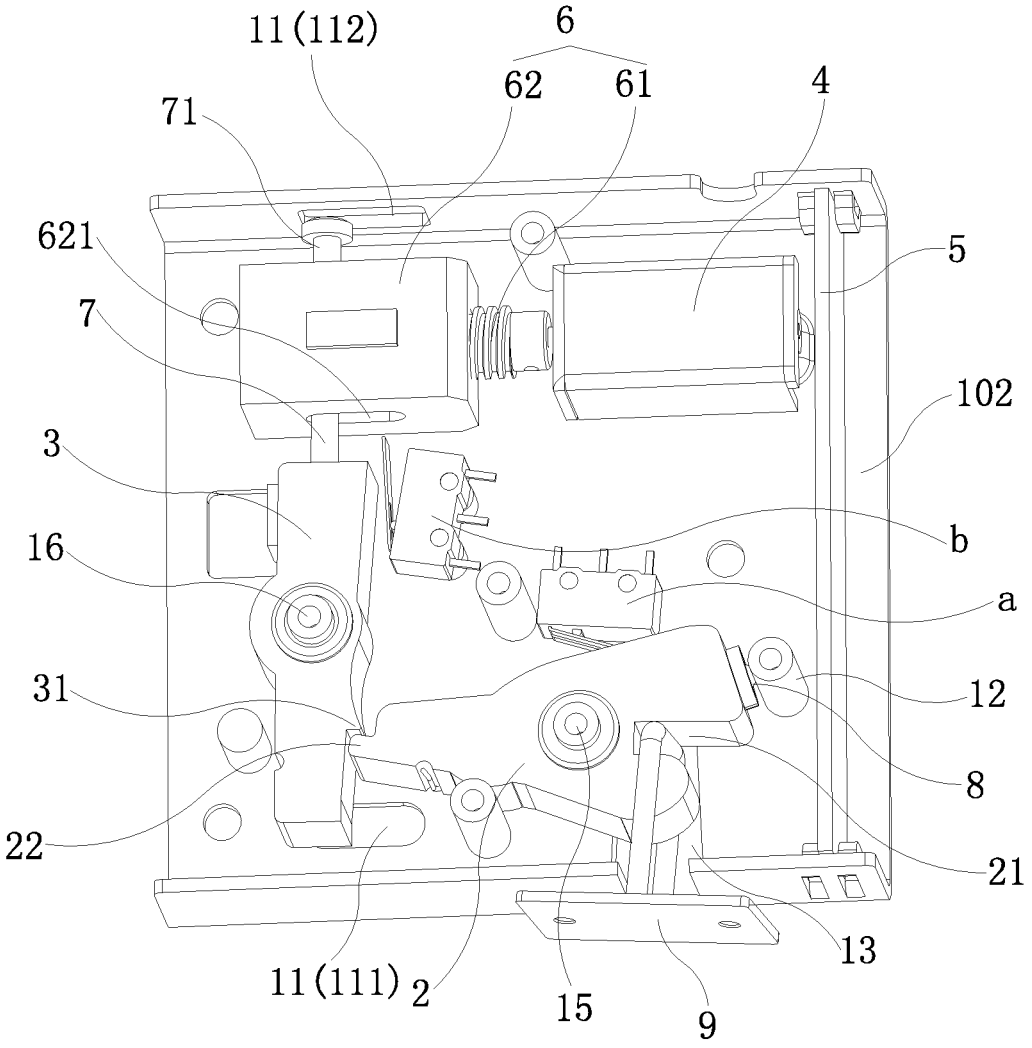
FIG. 2 is a partial schematic view of the first embodiment of the present invention in a locked state.
Figure 3:
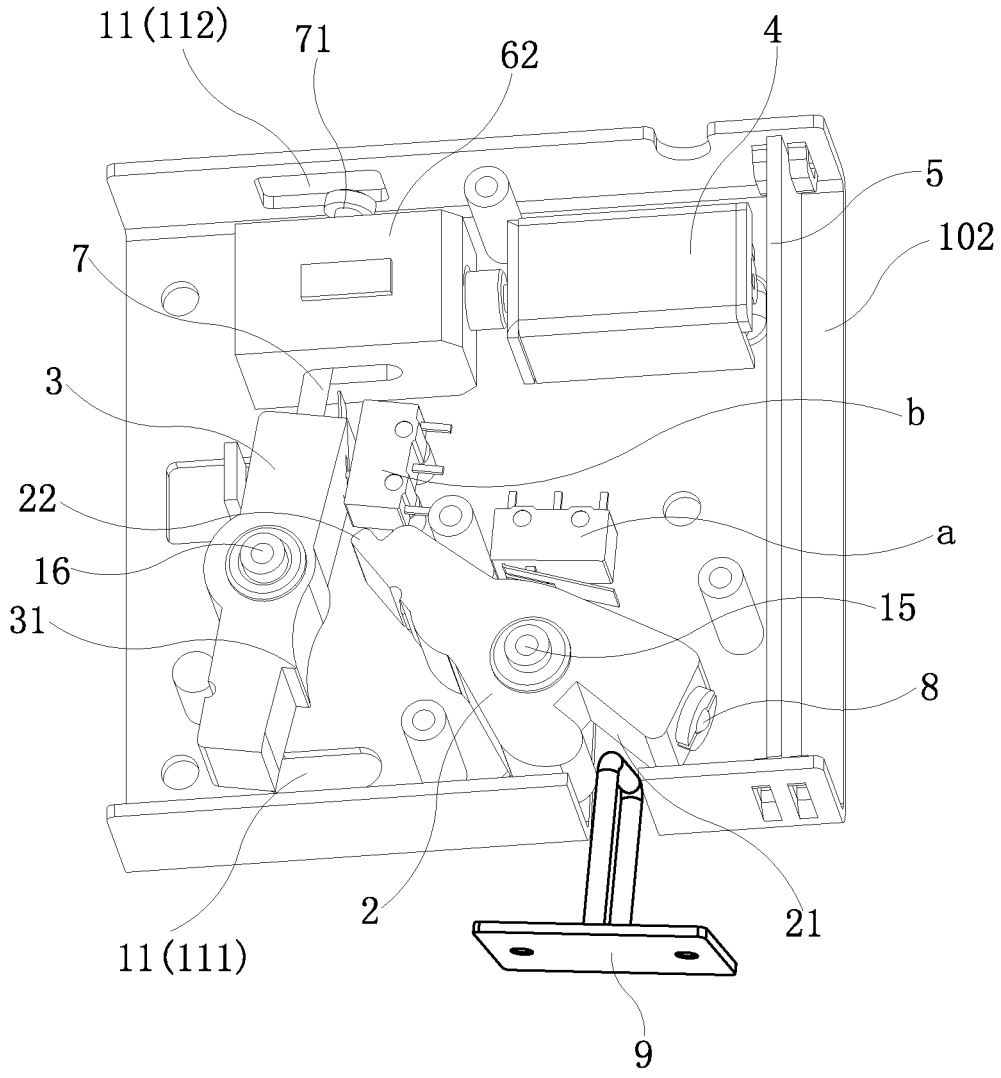
FIG. 3 is a partial schematic view of the first embodiment of the present invention in an unlocked state.
Figure 4:
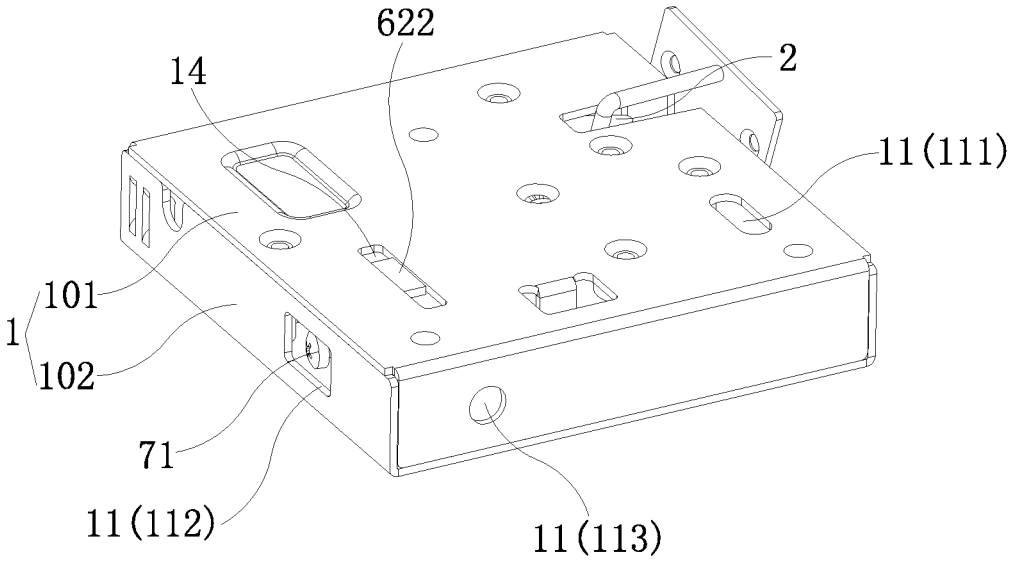
FIG. 4 is perspective view of the first embodiment of the present invention.
Figure 5:
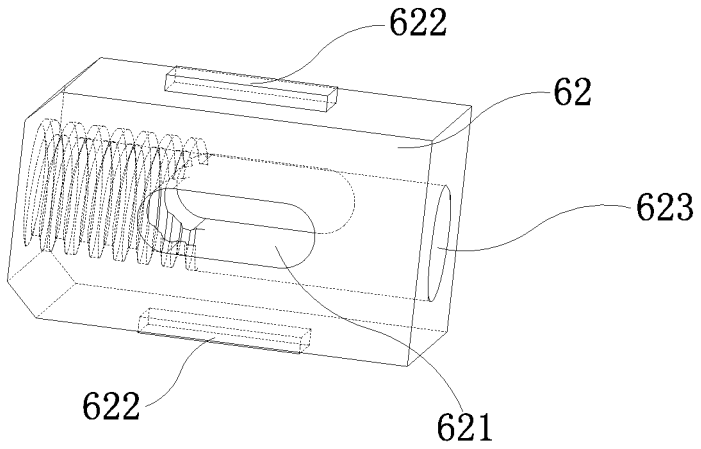
FIG. 5 is a schematic view of the slider of the present invention.
Figure 6:
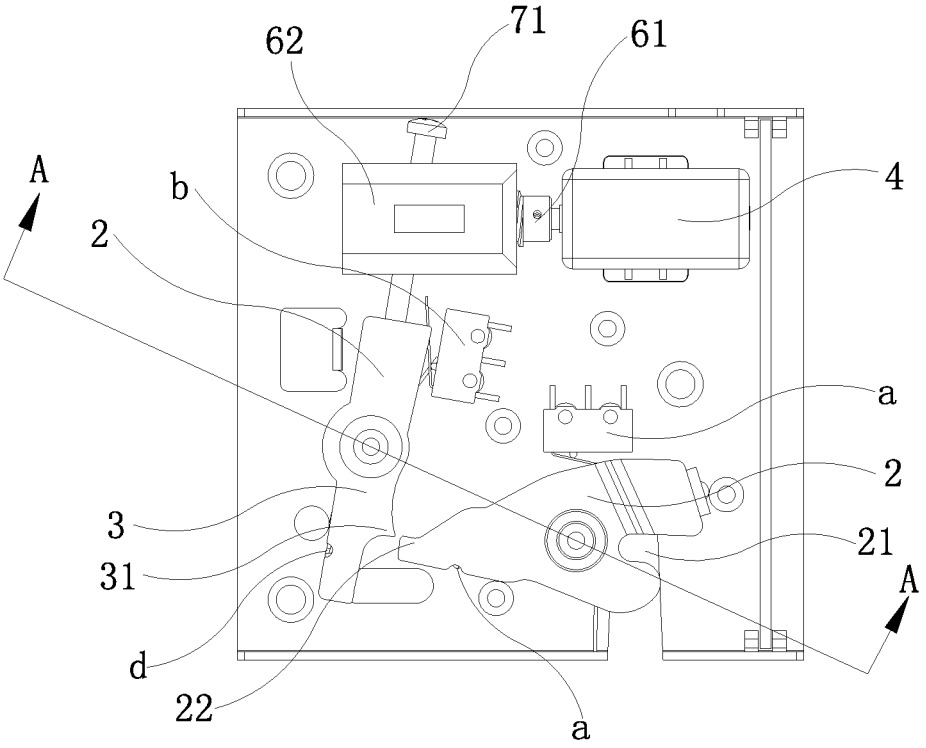
FIG. 6 is a partial schematic view of the first embodiment of the present invention.
Figure 7:
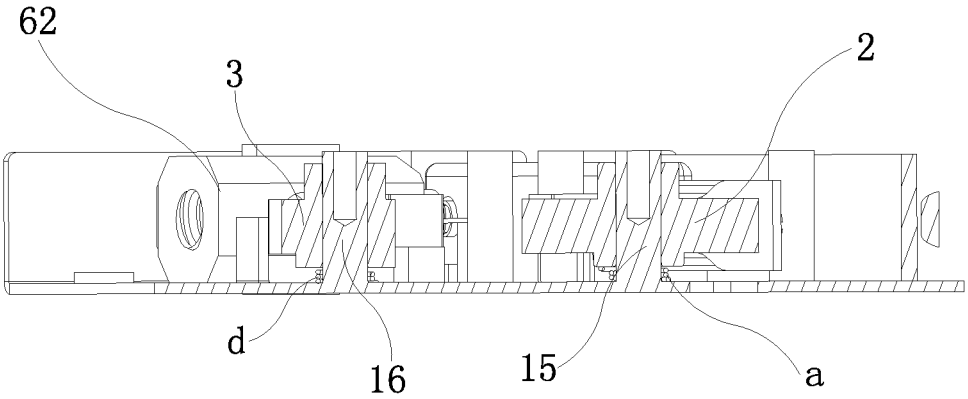
FIG. 7 is a cross-sectional view taken along line A-A of FIG. 6.

The electronic cabinet lock of the invention has a locked state and an unlocked state. The locked state is as shown in FIG. 2. The lock body 2 is in the locked position, the lock hook 9 is engaged in the engaging groove of the lock body 2, the second detent portion 31 of the limiting member 3 is engaged with the first detent portion 22 of the lock body 2, and the ball 8 is pressed against the side of the limiting post 12. The first elastic member is in an energy storage state, and the second elastic member is in a return state. The rod 7 on the limiting member 3 leans against the left end of the elongate hole 621. When the unlocking is required, the main control board 5 is given a command (the command may be a WiFi command, a scanning two-dimensional code command, a manual pressing command, etc., which is the prior art), so that the main control board 5 controls the motor 4 to start. The motor 4 drives the screw rod 61 to rotate in the forward direction. Because the screw rod 61 is threadedly connected to the slider 62, as the screw rod 61 rotates in the forward direction, the slider 62 slides to the right to drive the limiting member 3 to swing a certain angle in a clockwise direction (relative to the viewing angle of FIG. 1), so that the second detent portion 31 of the limiting member 3 is disengaged from the first detent portion 22 of the lock body 2 to release the lock body 2 while the second elastic member is in an energy storage state. At this time, the door can be opened. But, since the ball 8 is held against the limiting post 12, the lock body 2 is kept in the locked position. The lock hook is still in the engaging groove 21 of the lock body 2, so the door will not open automatically. When the user opens the door, the lock hook 9 drives the lock body 2 to rotate a certain angle to disengage the ball 8 from the limiting post 12. Thereafter, the lock hook 9 is disengaged from the lock body 2 to open the door, and the lock body 2 is rotated to the unlocked position by the restoring force of the first elastic member, as shown in FIG. 3. During the above unlocking process, when the limiting member 3 is rotated clockwise in place, the second micro switch b is activated, and the second micro switch b generates a signal to the main control board 5, so that the main control board 5 controls the motor 4 to stop rotating.

When the door is to be closed, the door is pushed for the lock hook 9 on the door to engage with the engaging groove 21 of the lock body 2. During this process, the lock hook 9 pushes the lock body 2 to overcome the elastic force of the first elastic member and rotate to the locked position, and the lock body 2 touches the first micro switch a. The first micro switch a generates a signal to the main control board, so that the main control board 5 activates the motor 4. The motor 4 drives the screw rod 61 to rotate reversely, so that the slider 62 slides to the left to release the rod 7, and the second elastic member releases energy to drive the limiting member 3 to rotate counterclockwise to the position where the lock body 2 is limited, as shown in FIG. 2.

Figure 8:
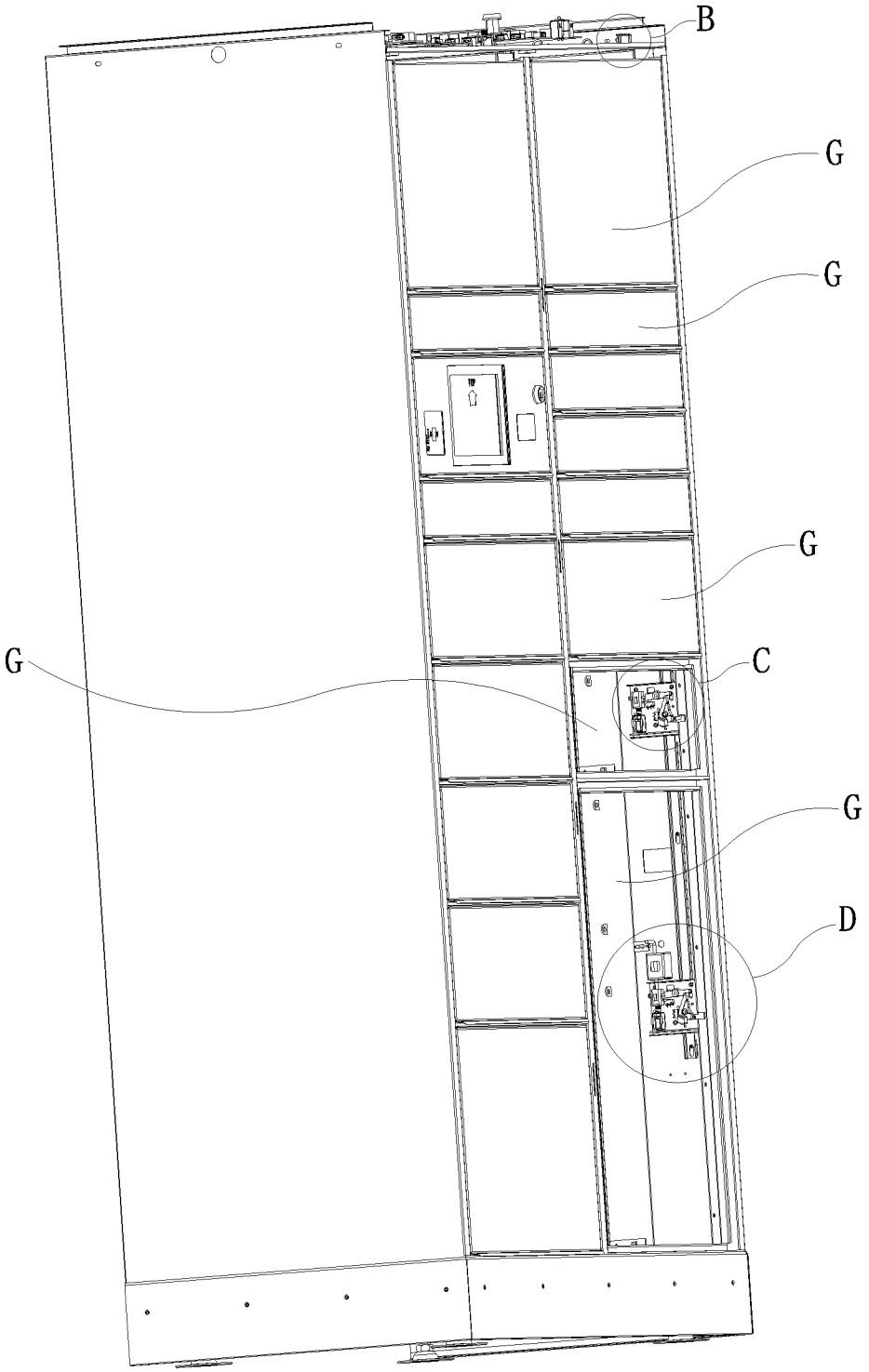
FIG. 8 is a schematic view of the first embodiment of the present invention applied to a cabinet.
Figure 9:
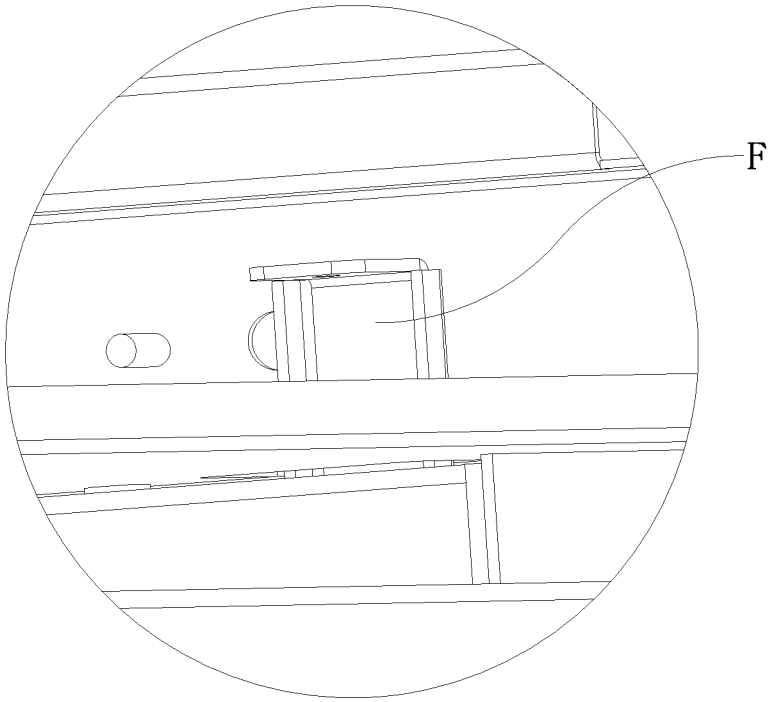
FIG. 9 is an enlarged view of circle B of FIG. 8.
Figure 10:
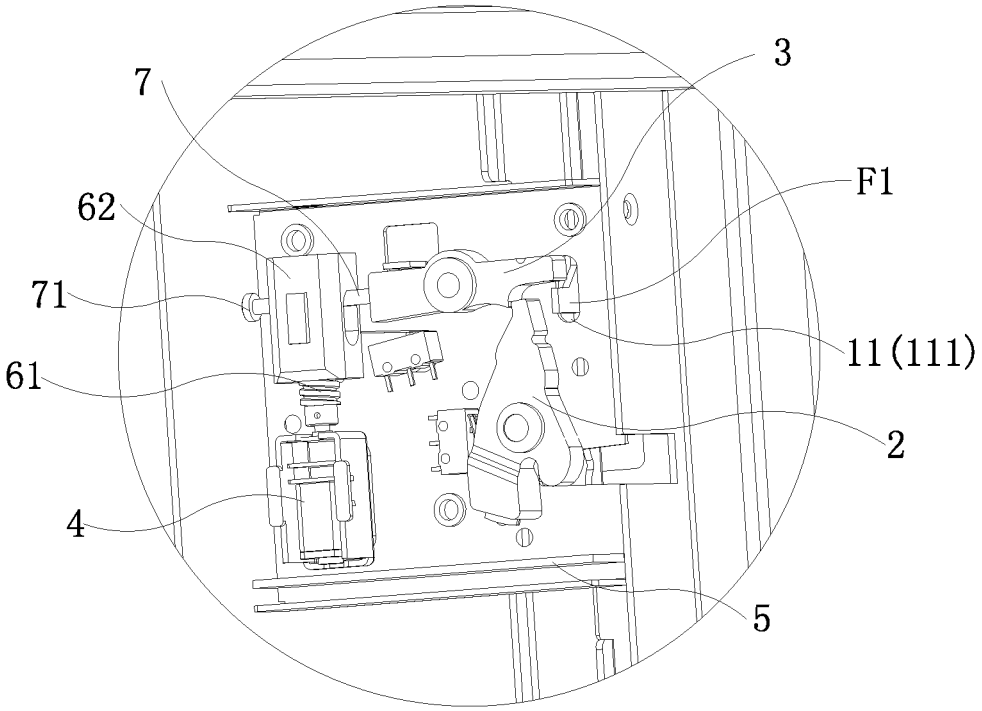
FIG. 10 is an enlarged view of circle C of FIG. 8.
Figure 11:
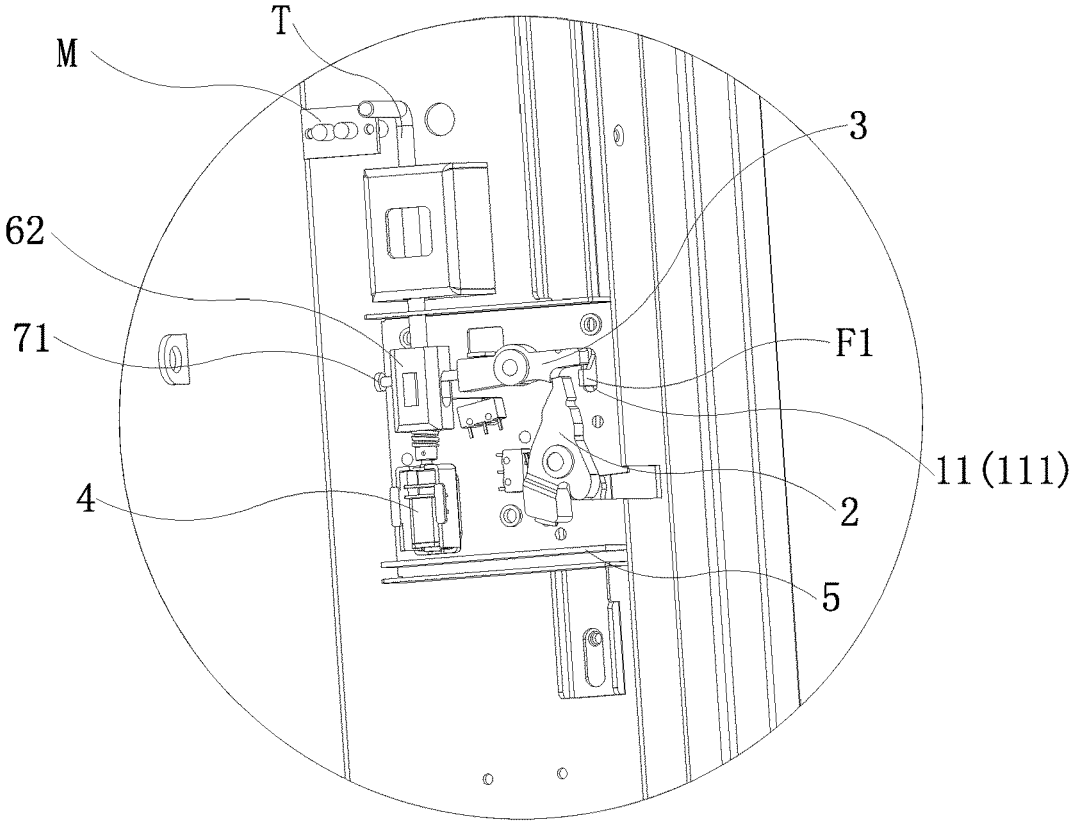
FIG. 11 is an enlarged view of circle D of FIG. 8.
Figure 12:
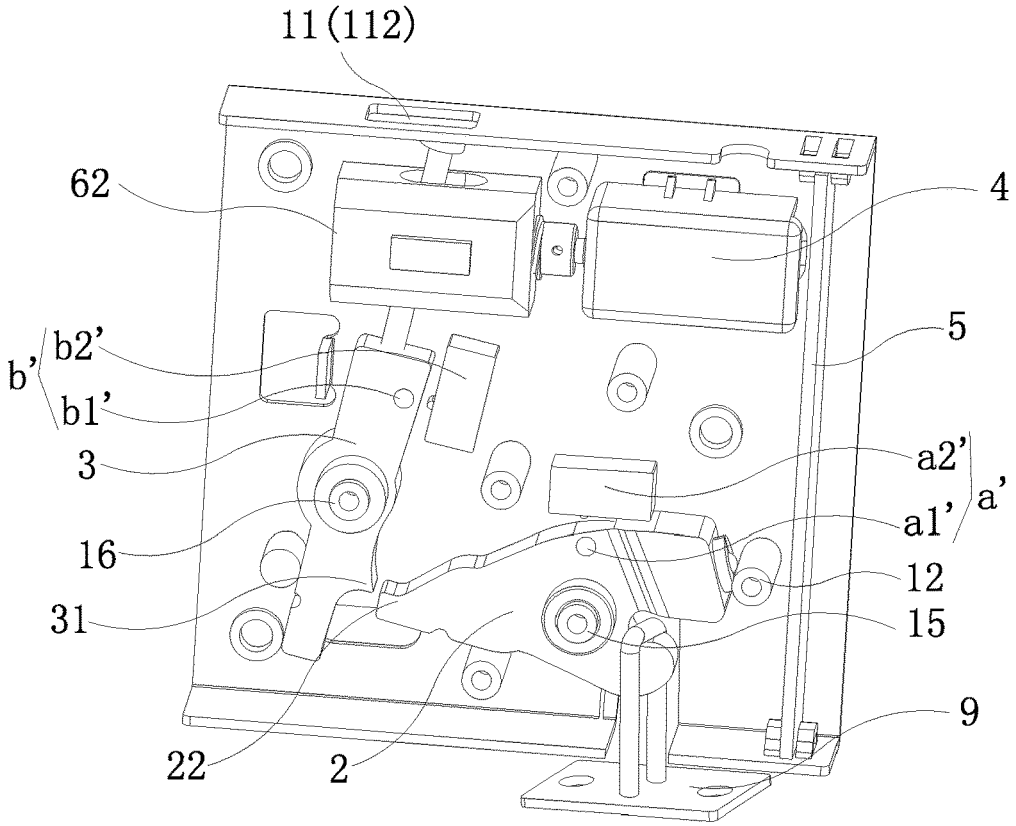
FIG. 12 is a partial schematic view of a first embodiment of the present invention in a locked state.

Since the limiting member 3 has a predetermined movable space relative to the slider 62, the limiting member 3 is driven by the motor 4 and the transmission mechanism 6 to rotate so as to release the lock body 2. Thus, the lock housing 1 may be provided with an emergency unlocking hole 11 for manually rotating the limiting member 3 to release the lock body 2. In the case of power failure or in the case when the main control board 5 or the motor 4 is damaged, one can release the lock body 2 by using a tool to pass through the emergency unlocking hole 11 for driving the limiting member 3 to rotate, thereby performing manual unlocking. The tool may be a screwdriver or a hex wrench. Specifically, the lock housing 1 has three emergency unlocking holes 11. The first emergency unlocking hole is a first through hole 111 that is formed on the lock housing 1 and corresponds in position to the end of the limiting member 3. The second emergency unlocking hole is a second through hole 112 that is formed on the lock housing 1 and corresponds in position to the free end 71 of the rod 7. One end of the slider 62 is threadedly connected to the screw rod 61, and another end of the slider 62 is provided with a perforation 623 communicating with the elongate hole 621 and extending along the sliding direction of the slider 62. The third emergency unlocking hole is a third through hole 623 that is formed on the lock housing 1 and corresponds to the perforation 623. When the present invention is mounted to a cabinet G, the cabinet G is provided with an opening corresponding to the first through hole 111 or the second through hole 112. In this way, the tool can pass through the opening and the first through hole 111 from the outside the cabinet G to rotate the limiting member 3 for releasing the lock body 2, or the tool can pass through the opening and the second through hole 112 to rotate the limiting member 3 for releasing the lock body 2, thereby performing manual unlocking. As shown in FIG. 8 to FIG. 11, in the case that the cabinet is provided with at least one row of compartments. Each row of compartments includes at least two compartments G. The electronic cabinet lock of the present invention is mounted to each compartment G of each row of compartments and disposed on the same side. The side wall having the first through hole 111 of the lock housing 1 of each electronic cabinet lock is connected to the side wall of the compartment G. The cabinet is provided with a movable emergency lever F corresponding to each row of compartments. The emergency lever F on each row of compartments is provided with a plurality of push blocks F1 corresponding to the electronic cabinet locks of the row of compartments. Each push block F1 of the emergency lever F of each row of compartments is inserted into the first through holes 111 of each electronic cabinet lock of the row of compartments. In this way, by moving the emergency lever F of each row of compartments, each push block F1 of the emergency lever F of each row of compartments can be used to push the limiting member 3 of each electronic cabinet lock of the row of compartments, thereby unlocking multiple electronic cabinet locks at a time. As shown in FIG. 8 and FIG. 11, a tool T may be disposed in the compartment G. Thus, if one is accidentally locked in the compartment G, at this time, one can use the tool T in the compartment G to rotate the limiting member 3 by using the tool T to pass through the second through hole 112 or the third through hole 113 for releasing the lock body 2, thereby performing manual unlocking. In order to facilitate the user to find the tool T in the compartment G, the compartment G may be provided with a lamp M.

In summary, the electronic cabinet lock of the present invention uses the transmission mechanism composed of the slider and the screw rod as a transmission assembly between the motor and the limiting member. Compared with the prior art that adopts a mechanical transmission mechanism composed of a gear reduction group, a push rod and so on. The transmission mechanism of the present invention has fewer components and is a simple structure. The assembly is easier, and the mechanical failure rate is lower. The arrangement of the ball 8 and the limiting portion of the present invention enables the present invention to restrict the first elastic member from driving the lock body 2 to be returned after the limiting member releases the lock body. Therefore, the lock body 2 is held in the locked position to keep the lock hook in the engaging groove 21 of the lock body 2, so as to keep the door from being opened. The door needs to be pulled by hand to open the door. The invention may be applied to some cabinets (such as cabinet freezers, refrigerated cabinets, etc.) that need to reduce the time when the cabinets are in an open state. In particular, when the present invention in cooperation with a door closer is applied to such a cabinet, the effect is better. In addition, the arrangement of the ball 8 and the limiting portion can restrict the first elastic member from driving the lock body 2 to be returned when the door is closed, that is, when the lock hook pushes the lock body 2 to the locked position. Thereby, the motor 4 and the transmission mechanism 6 have sufficient time to drive the limiting member 3 to limit the lock body 2 so as to complete the locking.

It should be noted that, in a second embodiment of the present invention, the first switch mechanism is a first Hall switch a', including a first magnet a1' disposed on the lock body 2 and a first magnetic field detecting part a2' electrically connected to the main control board 5. When the lock body 2 is rotated to the locked position, the first magnetic field detecting part a2' detects the magnetic field of the first magnet a1' and transmits a signal to the main control board 5. In the second embodiment of the present invention, the second switch mechanism is a second Hall switch b', including a second magnet b1' disposed on the limiting member 3 and a second magnetic field detecting part b2' electrically connected to the main control board 5. When the limiting member 3 is rotated to the position where the lock body 2 is released, the second magnetic field detecting part b2' detects the magnetic field of the second magnet b1' and transmits a signal to the main control board 5.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electronic cabinet lock, comprising a lock housing, a lock body, a limiting member, a motor and a main control board, the lock body and the limiting member being rotatably disposed in the lock housing respectively, a first elastic member for returning the lock body being disposed between the lock body and the lock housing, the lock body being provided with an engaging groove configured to mate with a lock hook on a door, a detent structure being provided between the lock body and the limiting member for the liming member to limit the lock body; the motor being electrically connected to the main control board, the limiting member being driven by the motor through a transmission mechanism, the transmission mechanism including a slider and a screw rod, the slider being slidably disposed in the lock housing through a sliding guide structure and being movably connected to the limiting member; the screw rod being driven to rotate by the motor, the screw rod being threadedly connected to the slider for driving the slider to slide; wherein the limiting member has a predetermined movable space relative to the slider, the limiting member is driven by the motor and the transmission mechanism to rotate so as to release the lock body, and a second elastic member for returning the limiting member is disposed between the limiting member and the lock housing; wherein the lock housing is provided with an emergency unlocking hole for manually rotating the limiting member to release the lock body; wherein the emergency unlocking hole is a first through hole that is formed on the lock housing and corresponds in position to an end of the limiting member.

2. The electronic cabinet lock as claimed in claim 1, wherein the slider is provided with an elongate hole in a longitudinal direction along a sliding direction of the slider, the limiting member is provided with a rod, and the rod is slidably connected to the elongate hole.

3. The electronic cabinet lock as claimed in claim 2, wherein the lock housing is provided with an emergency unlocking hole for manually rotating the limiting member to release the lock body.

4. The electronic cabinet lock as claimed in claim 3, wherein the emergency unlocking hole is a first through hole that is formed on the lock housing and corresponds in position to an end of the limiting member.

5. The electronic cabinet lock as claimed in claim 3, wherein a free end of the rod extends out of the elongate hole, the emergency unlocking hole is a second through hole that is formed on the lock housing and corresponds in position to the free end of the rod.

6. The electronic cabinet lock as claimed in claim 3, wherein one end of the slider is threadedly connected to the screw rod, another end of the slider is provided with a perforation communicating with the elongate hole and extending along the sliding direction of the slider; the emergency unlocking hole is a third through hole that is formed on the lock housing and corresponds to the perforation.

7. The electronic cabinet lock as claimed in claim 1, wherein the lock body is provided with a ball, and the lock housing is provided with a limiting portion to cooperate with the ball; wherein when the lock body is rotated to a locked position, the ball abuts against the limiting portion and restricts the first elastic member from driving the lock body to be returned.

8. The electronic cabinet lock as claimed in claim 1, further comprising a first switch mechanism controlled by the lock body and a second switch mechanism controlled by the limiting member, the first switch mechanism and the second switch mechanism being electrically connected to the main control board for controlling a working state of the motor.

9. The electronic cabinet lock as claimed in claim 8, wherein the first switch mechanism is a micro switch that is activated when the lock body is rotated to a locked position, the micro switch is disposed in the lock housing; or, the first switch mechanism is a first Hall switch that includes a first magnet disposed on the lock body and a first magnetic field detecting part electrically connected to the main control board, when the lock body is rotated to the locked position, the first magnetic field detecting part detects a magnetic field of the first magnet.

10. The electronic cabinet lock as claimed in claim 8, wherein the second switch mechanism is a micro switch that is activated when the limiting member is rotated to a position where the lock body is released, the micro switch is disposed in the lock housing; or, the second switch mechanism is a second Hall switch that includes a second magnet disposed on the limiting member and a second magnetic field detecting part electrically connected to the main control board, when the limiting member is rotated to the position where the lock body is released, the second magnetic field detecting part detects a magnetic field of the second magnet.

11. The electronic cabinet lock as claimed in claim 1, wherein the detent structure includes a first detent portion disposed on the lock body and a second detent portion disposed on the limiting member, and the first detent portion is movably engaged with the second detent portion.

12. The electronic cabinet lock as claimed in claim 1, wherein the sliding guide structure includes a guide rail disposed on the slider and a sliding groove disposed on the lock housing, the guide rail and the sliding groove are disposed along a sliding direction of the slider and are slidably mated with each other; and the screw rod is coaxially connected to an output shaft of the motor.

13. The electronic cabinet lock as claimed in claim 1, wherein the lock body is rotatably sleeved on a first rotating shaft of the lock housing, the first elastic member is a first torsion spring, a spiral portion of the first torsion spring is sleeved on the first rotating shaft, two ends of the first torsion spring lean against the lock body and the lock housing respectively; the limiting member is rotatably sleeved on a second rotating shaft of the lock housing, the second elastic member is a second torsion spring, a spiral portion of the second torsion spring is sleeved on the second rotating shaft, and two ends of the second torsion spring lean against the limiting member and the lock housing respectively.

* * * * *